US006461203B2

(12) United States Patent
Todo

(10) Patent No.: US 6,461,203 B2
(45) Date of Patent: Oct. 8, 2002

(54) ELECTRICAL CONNECTOR HAVING DOUBLE-LOCKING MECHANISM

(75) Inventor: Nobuhisa Todo, Akishima (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 09/963,621

(22) Filed: Sep. 26, 2001

(65) Prior Publication Data

US 2002/0037673 A1 Mar. 28, 2002

(30) Foreign Application Priority Data

Sep. 26, 2000 (JP) ..... 2000-291492

(51) Int. Cl.[7] ..... H01R 13/436
(52) U.S. Cl. ..... 439/752
(58) Field of Search ..... 439/752, 595

(56) References Cited

U.S. PATENT DOCUMENTS

| | | | | |
|---|---|---|---|---|
| 4,867,712 A | | 9/1989 | Kato et al. | 439/752 |
| 4,946,399 A | | 8/1990 | Kawashima | 439/752 |
| 5,211,586 A | * | 5/1993 | Maue et al. | 439/752 |
| 5,257,951 A | * | 11/1993 | Maeda | 439/752 |
| 5,316,504 A | | 5/1994 | Jinno | 439/752 |
| 5,630,736 A | * | 5/1997 | Yagi et al. | 439/752 |
| 5,885,105 A | | 3/1999 | Takagishi et al. | 439/595 |
| 6,089,928 A | | 7/2000 | Miwa et al. | 439/752 |

FOREIGN PATENT DOCUMENTS

EP 0 723 312 A2 7/1996

* cited by examiner

*Primary Examiner*—Gary F. Paumen
(74) *Attorney, Agent, or Firm*—Michael Best & Friedrich LLC

(57) ABSTRACT

In a temporary locking state, there is a little clearance C between an end wall of a contact hole provided at an insulator and an end surface of a contact. When a double locking member is pushed down from a temporary locking position to a regular locking position, an engaging portion of the double locking member pushes an inclined plane of a second stabilizer of the contact. Therefore, the contact moves to the forward direction. When the end surface of the contact is brought into contact with the end wall of the contact accommodating chamber, the contact stops. Then, the clearance C becomes naught. Since the contact of the connector cannot move to the insulator, contacts of the connector and a mating connector can stably comes into contact with each other.

8 Claims, 17 Drawing Sheets

ELECTRICAL CONNECTOR HAVING DOUBLE-LOCKING MECHANISM

BACKGROUND OF THE INVENTION

This invention relates to an electrical connector which locks doubly a plurality of contacts in an insulator thereof. Here, double locking means temporary locking by lances of the insulator and regular locking by a double locking member.

An essential point of a first conventional electrical connector will be described referring to FIGS. 1, 2, 3 and 4. The first conventional electrical connector is described in Japanese Unexamined Patent Publication (A) No. 325814 of 1994 (JP 6-325814 A).

As shown in FIGS. 1 and 2, a connector consists of an insulator 21, a double locking member (retainer) 22, a restraining member 23, and a plurality of contacts 24. The double locking member (retainer) 22, to be described later, is located at either a temporary locking position or a regular locking portion.

The insulator 21 is formed in the shape of a box as a whole. A pair of lock levers 25 which interlocks a mating connector is installed at the upper surface of the insulator 21. An end of each lock lever 25 is fixed at the upper surface of the insulator 21, and the other end of each lock lever 25 is a free one. A finger-pressure portion 26 is installed at the free ends of both lock levers 25. The finger-pressure portion 26 is located at a concavity of a frame-shaped thick portion 27 which is formed at the rear end side (that is, the opposite side to the connecting side with the mating connector) of the insulator 21. When the connector connects with the mating connector (not shown), the finger-pressure portion 26 sinks once toward the inside of the insulator 21. Subsequently, the finger-pressure portion 26 returns to the initial portion thereof and engages with the mating connector.

A plurality of contact-accommodating chambers or contact holes 28 which accommodate each contact 24 partitively are formed in the insulator 21. The contact-accommodating chambers 28 are constituted in two steps in the up and down direction of the insulator 21. The eleven contact-accommodating chambers 28 are formed at each step, respectively. The rear end portion of each contact-accommodating chamber 28 in the upper step is located at the inside of the insulator 21 in order to accommodate the double locking member 22 and forms a space 29 which accommodates the double locking member 22. The double locking member 22 is located on the partitive walls which partition the contact-accommodating chambers 28 in the lower step.

Further, the rear end portions of the partitive walls which partition the contact-accommodating chambers 28 in the lower step draw back to the inside of the insulator 21 and form a space 30 which accommodates the restraining member 23.

An engaging projection 27*a* which engages with two engaging grooves 22*e* and 22*f* of the double locking member 22 is formed on both end surfaces of the concavity of the frame-shaped thick portion 27, respectively. In FIG. 1, only the engaging projection 27*a* of the left side of the frame-shaped thick portion 27 appears. However, since FIG. 1 is a perspective view, the engaging projection 27*a* of the right side of the frame-shaped thick portion 27 does not appear.

Furthermore, an engaging window 27*b* is formed at the rear inside of both the right and left sides of the frame-shaped thick portion 27, respectively.

A pair of engaging projections 23*a* formed protrusively from both the right and left sides of the restraining member 23 engages with a pair of the engaging windows 27*b* bored at both the right and left sides of the frame-shaped thick portion 27, respectively. In FIG. 1, only the engaging window 27*b* of the left side of the frame-shaped thick portion 27 appears. However, since FIG. 1 is a perspective view, the engaging window 27*b* of the right side of the frame-shaped thick portion 27 does not appear.

A pair of engaging projections 23*b* formed protrusively from the top side of the restraining member 23 engages with a pair of engaging holes (not shown) bored at the upper inside of the frame-shaped thick portion 27, respectively.

The double locking member 22 which is accommodated in the space 29 of the insulator 21 has an upper-plate portion 22*a* and a lower-plate portion 22*b*. The upper-plate portion 22*a* faces parallel and separately the lower-plate portion 22*b*. A plurality of partitive walls are installed as one body at a given interval between the upper-plate portion 22*a* and the lower-plate portion 22*b*. A plurality of contact through-holes 22*c* are constituted by the partitive walls. The contact through-holes 22*c* communicate with the contact-accommodating chambers 28 in the upper step of the insulator 21, respectively.

A pair of finger-pressure portions 22*d* is formed protrusively on the upper-portion 22*a* of the double locking member 22. Each of the finger-pressure portions 22*d* is inserted between the concavity of the frame-shaped thick portion 27 and the finger-pressure portion 26 of the locking lever 25, respectively. A convex stripe 22*g* is formed horizontally at the outside of each finger-pressure portion 22*d*. The engaging grooves 22*e* and 22*f* are formed above and below each convex stripe 22*g*, respectively. The engaging grooves 22*e* and 22*f* engage with the engaging projection 27*a* which is formed on each end surface of the concavity of the frame-shaped thick portion 27. When the double locking member 22 is located at a temporary locking position, the engaging groove 22*f* disposed at the lower side engages with the engaging projection 27*a*. That is to say, the engaging groove 22*f* disposed at the lower side is a temporary engaging groove. When the double locking member 22 is located at the descended position (i.e. a regular locking position), the engaging groove 22*e* disposed at the upper side engages with the engaging projection 27*a*. That is to say, the engaging groove 22*e* is a regular engaging groove.

Next, after the double locking member 22 is inserted into the space 29 of the insulator 21, the restraining member 23 is inserted into the space 30 of the insulator 21. The restraining member 23 prevents the double locking member 22 from escaping out of the space 29. The bottom side of the restraining member 23 is joined with the bottom end of the insulator 21 through a hinge portion 31. When the restraining member 23 is lifted up to the direction shown by an arrow around the hinge portion 31, the engaging projections 23*a*, 23*a*, 23*b*, and 23*b* engage with the corresponding engaging windows 27*b* or the engaging holes (not shown) formed at the insulator 21, respectively. A plurality of contact through-holes 23*c* are formed in a lattice at the restraining member 23 also. The contact through-holes 23*c* communicate with the contact accommodating chambers 28 in the lower step of the insulator 21 and the contact through-holes 22*c* in the upper step of the double locking member 22.

Each contact 24 is equipped with a first engaging portion 24*a* engaging a lance 21*a* (refer FIG. 3) which is formed in the insulator 21 and a second engaging portion 24*b* engaging the double locking member 22.

Further, the description will proceed to insertion of each contact 24 into the restraining member 23 and the insulator 21. At first, each engaging projection 27*a* of the frame-shaped thick portion 27 engages with each engaging groove 22*f* of the double locking member 22. The double locking member 22 is located at the temporary locking position. In this state, each contact 24 is inserted from each contact insert-hole 23*c* of the restraining member 23 to each contact accommodating chamber 28 in the insulator 21.

In case of the double locking member 22 is located at the temporary locking position, as shown FIG. 3, each lance 21*a* formed in the insulator 21 engages with the first engaging portion 24*a* of each contact 24. However, both lower edges of the upper-plate portion 22*a* and the lower-plate portion 22*b* of the double locking member 22 do not engage with the side surface of the second engaging portion 24*b* of each contact 24. In this state, each contact 24 can be inserted into and extracted from the restraining member 23 and the insulator 21. Incidentally, each lance 21*a* can be released from the first engaging portion 24*a* of each contact 24 by the following way. That is to say, each lance 21*a* having elasticity is deformed by way of a screw driver and the like.

Furthermore, as shown in FIG. 4, when the finger-pressure portions 22*d* of the double locking member 22 is pushed by an operator's finger, the double locking member 22 goes down. Thereupon, both the lower edges of the upper-plate portion 22*a* and the lower-plate portion 22*b* of the double locking member 22 engage with the side surface of the second engaging portion 24*b* of each contact 24. When the double locking member 22 has reached the regular locking position, each engaging projection 27*a* of the insulator 21 gets over each convex stripe 22*g* of the double locking member 22 and engages with each regular engaging groove 22*e*. Then, the double locking member 22 is prevented from moving (i.e. rising) thereof hereafter.

Incidentally speaking, when even a contact 24 is located in a non-perfect inserting position (i.e. a half inserting position), the bottom surface of the upper-plate portion 22*a* or the lower-plate portion 22*b* of the double locking member 22 hits against the top surface of the second engaging portion 24*b* of the contact 24. Therefore, the double locking member 22 is prevented from moving thereof to the regular locking position. Consequently, it can be detected with ease that even one contact 24 is located in a half inserting position.

Succeedingly, an essential point of a second conventional electrical connector will be described referring to FIGS. 5 to 13. The second conventional electrical connector is described in Japanese Unexamined Patent Publication (A) No. 195456 of 1999 (JP 11-195456 A).

Referring FIGS. 5 and 6, a socket connector 40 is equipped with a socket insulator 41, two coil springs 42, and a sliding member 43. The front center of the sliding member 43 is equipped with a regulating protrusion 43*a*. The sliding member 43 is equipped with two protrusive portions 43*b* which guide and preserve the coil springs 42.

A plurality of contact accommodating holes 49 having an opening 49*a* (referring FIG. 8C etc.), respectively, for receiving pin contacts 52*a*, 52*b*, and 52*c* are formed at the front end and in the before and behind direction of the socket insulator 41. Each socket contact 44 connected a cable 60 at an end thereof is accommodated in each contact accommodating hole 49.

Further, an accommodating hole 45 for the sliding member 43 is formed at the center of the socket insulator 41. The sliding member 43 is accommodated in the accommodating hole 45 so as to slide in the before and behind direction and be biased in the before direction by the coil springs 42.

Furthermore, a pair of key grooves 46 is formed from the front end toward the back at both the right and left sides of the accommodating hole 45 in the socket insulator 41.

Referring to FIGS. 5 and 7, a pin connector 50 has a pin insulator 51. The pin insulator 51 is equipped with two contact accommodating holes 51*a* which stand horizontally in a line. An end of each of pin contacts 52*a*, 52*b*, and 52*c* for signals is inserted protrusively in the contact accommodating holes 51*a* through the rear wall of the pin insulator 51 from the outside of the pin insulator 51. And besides, the other end of each of the pin contacts 52*a*, 52*b*, and 52*c* lengthens to the rear of the pin insulator 51 and bends in a L-shape. Still more, the other ends of the pin contacts 52*a*, 52*b*, and 52*c* are arranged by a locator 53 and are inserted into through-holes 61*a* of a printed circuit board 61. The pin insulator 51 is fixed on the printed circuit board 61 by means of screws and so forth.

A pair of locking arms 54 is installed horizontally at the center in the top and bottom and crosswise directions of each contact accommodating hole 51*a*. A pair of keys 55 which is inserted into the pair of the key grooves 46 of the socket insulator 41 is provided at both the right and left sides of the pair of the locking arms 54.

Incidentally, as shown in FIG. 5, a pair of protrusive portions 41*a* provided at the top surface of the socket insulator 41 engages with a pair of grooves 51*b* provided at the top surface of each accommodating hole 51*a* of the pin connector 50. A pair of grooves 41*b* provided at the bottom surface of the socket insulator 41 engages with a pair of protrusive portions 51*c* provided at the bottom surface of each accommodating hole 51*a* of the pin connector 50. The relationship between the distance of the pair of the protrusive portions 41*a* and the distance of the pair of the grooves 51*b* and the relationship between the distance of the pair of the grooves 41*b* and the distance of the pair of the protrusive portions 51*c* differ in compliance with combinations of one of a plurality of the socket connectors 40 and one of a plurality of the pin connectors 50. This difference prevents between the socket connectors 40 and the pin connectors 50 from engaging in the wrong.

Referring to FIGS. 8A to 13C, the description will proceed to an engagement between the socket connector 40 and the pin connector 50.

Referring to FIG. 8A, when the socket connector 40 engages completely with the pin connector 50, the pair of locking arms 54 is accommodated in the accommodating hole 45 of the socket connector 40 and the regulating protrusion 43*a* of the sliding member 43 is inserted into a gap between the locking arms 54. Each of protrusive portions 54*a* of the locking arms 54 is accommodated in an accommodated hole 41*c* formed at the socket insulator 41 and engages with an engaging step portion 41*d* formed at the socket insulator 41. Therefore, the socket connector 40 is prevented from disengaging out of the pin connector 50, The pair of the keys 55 is inserted into the pair of the key grooves 46.

Referring to FIG. 8B, the insulator 41 is equipped with a pair of spring accommodating holes 41*e* which accommodates the pair of coil springs 42. On one hand, the sliding member 43 is equipped with a pair of spring accommodating portions 43*c* providing the pair of the protrusive portions 43*b* at both the upper and lower positions of the regulating protrusion 43*a* thereof. The pair of the coil springs 42 is accommodated all over the pair of spring accommodating holes 41*e* and the pair of spring accommodating portions 43*c*, including the circumference of each protrusive portion 43*b*.

A double locking member 47 locks regularly the socket contacts 44. A restraining member 48 prevents the double locking member 47 from separating out of the socket insulator 41.

As shown in FIG. 8C, the pin contacts 52*a*, 52*b*, and 52*c* for the signals come into contact with the socket contacts 44.

FIGS. 9A, 9B, and 9C show the states when the socket connector 40 does not yet engage the pin connector 50. A front plane 41 f of the insulator 41 of the socket connector 40 confronts with an opening 51*d* of the insulator 51 of the pin connector 50. After this, the insulator 41 is inserted into the accommodating holes 51*a* through the opening 51*d*.

FIGS. 10A, 10B, and 10C show the states when the outside of the insulator 41 of the socket connector 40 has been guided by the inner wall of the accommodating holes 51*a* and the socket connector 40 has partly engaged the pin connector 50. The keys 55 are inserted into the key grooves 46. However, each of the pin contacts 52*a*, 52*b*, and 52*c* for the signals does not yet come into contact with each of the contacts 44 of the socket connector 40.

FIGS. 11A, 11B, and 11C show the states that the socket connector 40 has more been inserted into the pin connector 50. The pair of the protrusive portions 54*a* of the locking arms 54 is restrained so as to bend toward the inside of the pin connector 50 by an opening 41*g* formed in the insulator 41 and a pair of guide walls 41*h* adjoining the opening 41*g*. The locking arms 54 bend elastically and enter into an accommodating hole 41*c* bored in the insulator 41 along the pair of the guide walls 41*h*. And so, the top ends of the protrusive portions 54*a* come into contact with the regulating protrusion 43*a* of the slide member 43. At the same time, the pin contacts 52*a*, 52*b*, and 52*c* enter into the inside of the insulator 41 from the openings 49*a* and begin to come into contact with the socket contacts 44, respectively.

Referring to FIGS. 12A to 13C, when the socket connector 40 is still more inserted into the pin connector 50, the protrusive portions 54*a* of the locking arms 54 push the regulating protrusion 43*a* of the sliding member 43 to the rearward, opposing a force of the coil springs 42 which bias the sliding member 43 to the left direction. In this state, when the socket connector 40 discontinues to be inserted into the pin connector 50, the socket connector 40 is given a force in the direction pushed out of the pin connector 50 by a reaction of the coil springs 42.

When the socket connector 40 is yet still more inserted into the pin connector 50 as shown in FIG. 8A, the protrusive portions 54*a* of the locking arms 54 are accommodated in the accommodating holes 41*c*. Since the sliding member 43 is always biased to the left direction by the coil springs 42, the regulating protrusion 43*a* enters between the locking arms 54. Accordingly, each locking arm 54 is limited bending to the inside thereof and each protrusive portion 54*a* is prevented from moving to the inside of each locking arm 54, Then, the socket connector 40 engages completely with the pin connector 50. At the same time, each of the pin contacts 52*a*, 52*b*, and 52*c* comes into contact with each of the contacts 44. Hereupon, when two voluntary contacts 44 are short-circuited and continuity of two pin contacts corresponding the two voluntary contacts 44 is detected, it is known that the socket connector 40 has completely engaged with the pin connector 50.

Next, the description will proceed to separation between the socket connector 40 and the pin connector 50.

In the states shown in FIGS. 8A, 8B, and 8C, a pull 43*d* of the sliding member 43 is moved to the right side by an operator's finger, the regulating protrusion 43*a* is pulled out of the protrusive portions 54*a* of the locking arms 54. Succeedingly, as shown in FIGS. 13A, 13B, and 13C, the regulating protrusion 43*a* has been pulled out of the protrusive portions 54*a* and the pin connector 50 is moved so as to be pulled out of the socket connector 40. Then, the pair of the locking arms 54 bends to the inside thereof and the protrusive portions 54*a* pass through the pair of the guide walls 41*h*. On this occasion, even if the pull 43*d* of the sliding member 43 is released from the operator's finger, the regulating protrusion 43*a* pushes the protrusive portion 54*a* out of the accommodating hole 41*c* by the reaction of the coil springs 42.

Further, as shown FIGS. 10A, 10B, and 10C, at first, each of the protrusive portions 54*a* is pulled out of the opening 41*g*. Next, each of the keys 55 is pulled out of each of the key grooves 46. At this time, each of the pin contacts 52*a*, 52*b*, and 52*c* for the signals is pulled out of the socket connector 40 and separates from each of the socket contacts 44. Continuously, as shown in FIGS. 9A, 9B, and 9C, the pin connector 50 separates completely from the socket connector 40, that is to say, the engagement 15C.

In the temporary locking state, when the bottom portion 75B of the double locking member 75 is pushed into the insulator 72, all of the three contacts 73 become to the regular locking state. In the regular locking state, a protrusion 75C formed at the double locking member 75 locks a corner 72C of the insulator 72 as shown in FIG. 14D. Consequently, the double locking member 75 is prevented from getting out of the insulator 72. In the regular locking state, since the bottom portion 75B of the double locking member 75 does not protrude from the bottom of the insulator 72, the socket connector 71 can engage with the pin connector.

In the three conventional electrical connectors above-mentioned, after the connector has engaged with the mating connector, even if each of the contacts is locked by the double locking member, a gap occurs between each of the contacts and the insulator of either the connector or the mating connector.

Therefore, each of the contacts of the connector and that of the mating connector are relatively movable each other. And so, when a vibration happens between the connector and the mating connector which are engaged with each other, a fretting corrosion occurs between each of the contacts of the connector and that of the mating connector. As a result, since an oxide is made on the surface of each contact, there is the possibility of a bad electrical continuity because an electrical resistance of each contact increases. And besides, the double locking member can not engage smoothly with each contact.

Further, the three conventional connectors above-mentioned has a complicated structure, a large number of parts, and a high price of manufacturing cost.

SUMMARY OF THE INVENTION

It is therefore an object of this invention to provide an electrical connector having a double locking mechanism in which there is no gap between a contact and an insulator thereof.

It is another object of this invention to provide an electrical connector having a double locking mechanism whose double locking member can engage smoothly with a contact.

It is still another object of this invention to provide an electrical connector having a double locking mechanism with a compact structure, a few parts, and a low price of manufacturing cost.

In accordance with an aspect of this invention, there is provided an electrical connector having a contact double-locking structure for locking a contact inserted into a contact hole in an insulator, the double-locking structure comprising a double locking member, the double-locking member can move to the direction perpendicular to the inserting direction of the contact in the insulator between a temporary locking position where the double-locking member is temporarily locked with a portion of the insulator and a regular locking position where the double-locking member is regularly locked at a different position in the insulator, the double-locking member being prevented from moving from the temporary locking position to the regular locking position by a stabilizer of the contact when the contact is incompletely inserted into the contact hole, the double-locking member can move from the temporary locking position to the regular locking position when the contact is completely inserted into the contact hole, the double-locking member having an engaging portion for engaging with the stabilizer to prevent the contact from moving out of the contact hole in the opposite direction to the inserting direction when the double-locking member is in the regular locking position, wherein the stabilizer has a guiding portion for guiding the engaging portion therealong when the double-locking member is moved into the regular locking position, whereby the contact is moved in the inserting direction and is brought into its completely inserted position without clearance between the stabilizer and the engaging portion.

Preferably, the guiding portion is an inclined plane.

Preferably, the stabilizer is equipped with a slit and is elastically deformable.

Preferably, the engaging portion is equipped with a groove for holding the stabilizer to prevent the contact from moving in a direction perpendicular to the longitudinal direction of the contact.

Preferably, the engaging portion is equipped with a groove for holding the stabilizer to prevent the contact from moving in a direction perpendicular to the longitudinal direction of the contact.

Preferably, the connector has a plurality of contacts with stabilizers held in a plurality of contact holes in the insulator. The double-locking member has a plurality of engaging portions which prevent the contacts, respectively, from moving in the opposite directions to the inserting direction by engaging with stabilizers of the contacts, respectively.

Preferably, the stabilizer is elastically deformable.

Preferably, the stabilizer is equipped with a slit.

Figure 1:
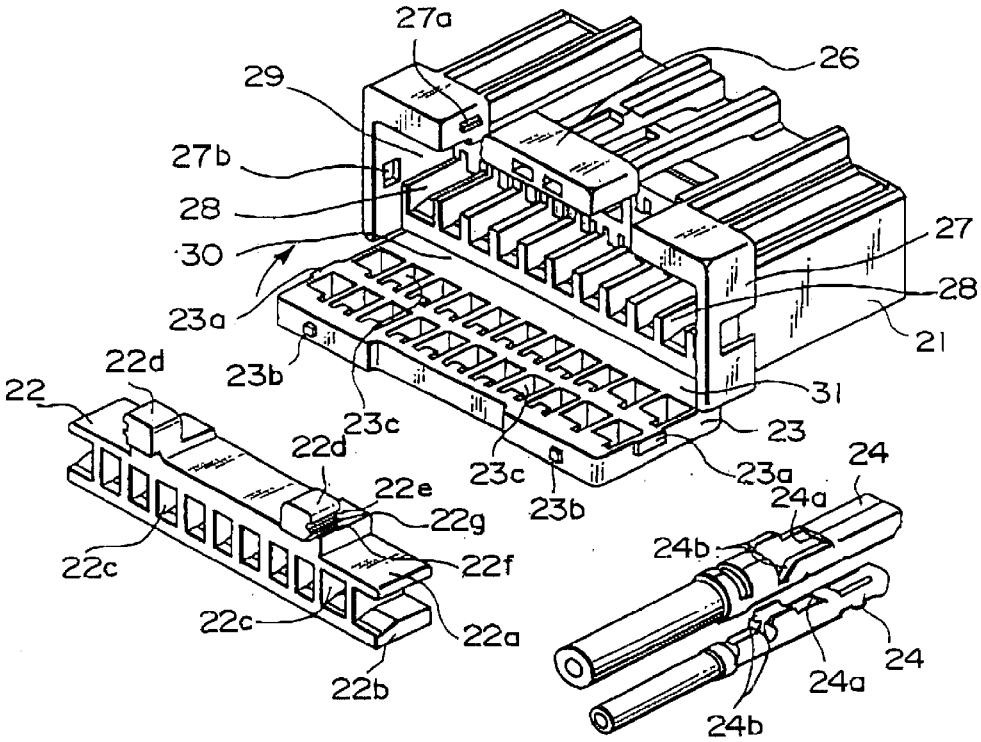
FIG. 1 PRIOR ART
FIG. 1 is an exploded perspective view of a first conventional electrical connector having a double locking mechanism.
Figure 2:
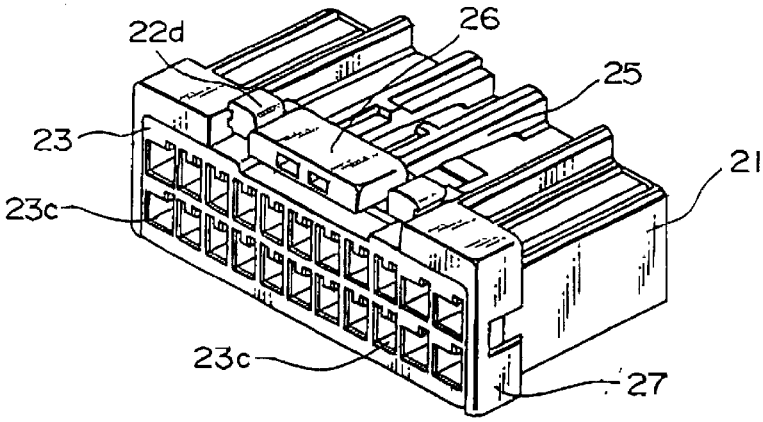
FIG. 2 PRIOR ART
FIG. 2 is an assembled perspective view of the first conventional electrical connector.
Figure 3:
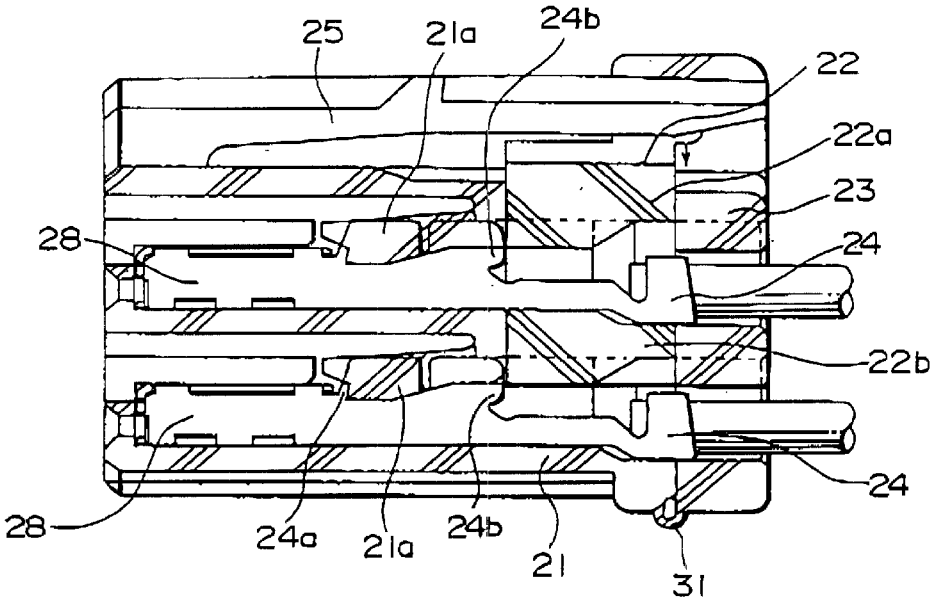
FIG. 3 PRIOR ART
FIG. 3 is a sectional view of an essential portion of the first conventional electrical connector in which a plurality of contacts are inserted and a double locking member is located in a temporary locking position.
Figure 4:
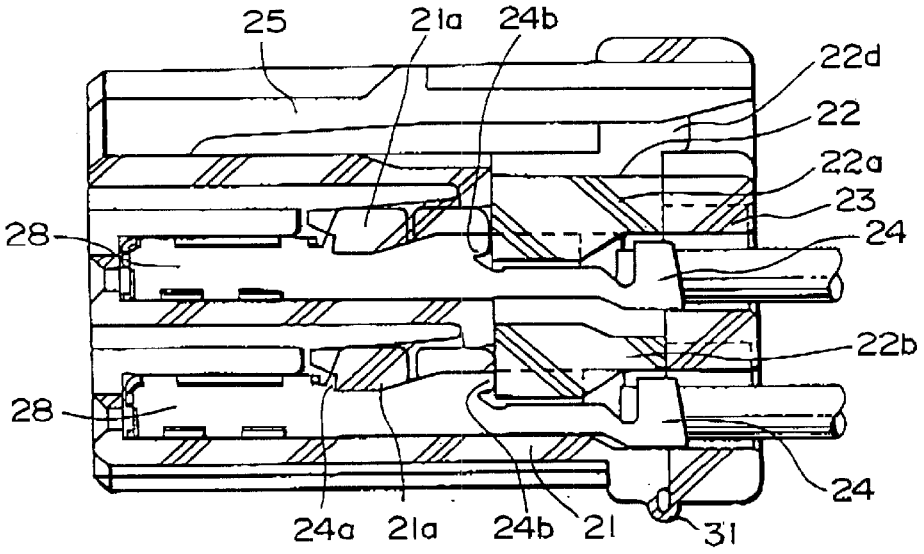
FIG. 4 PRIOR ART
FIG. 4 is a sectional view of the essential portion of the first conventional electrical connector in which the plurality of contacts are inserted and the double locking member is located in a regular locking position.
Figure 5:
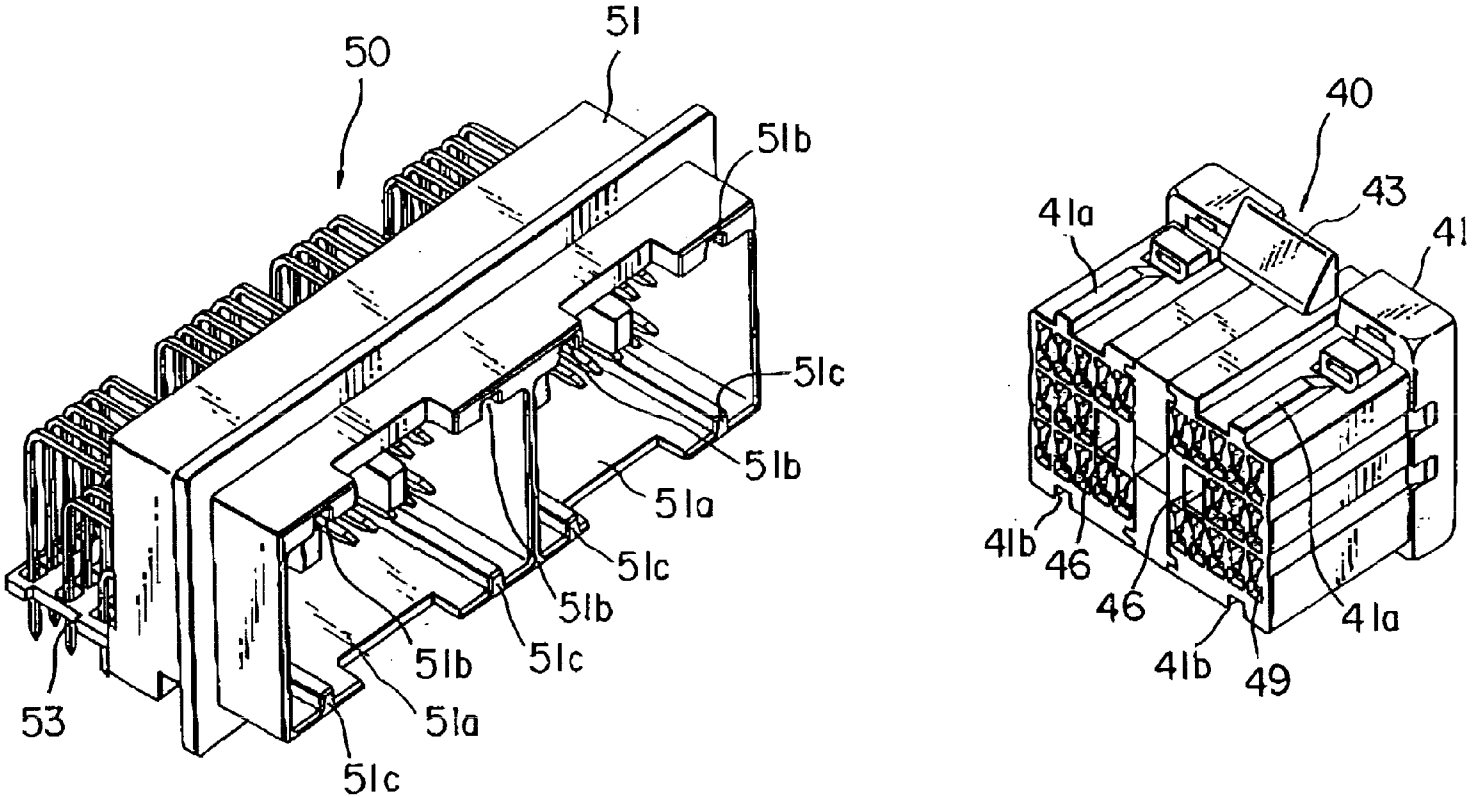
FIG. 5 PRIOR ART
FIG. 5 is a perspective view of a second conventional electrical connector having a double locking mechanism before engagement.
Figure 6:
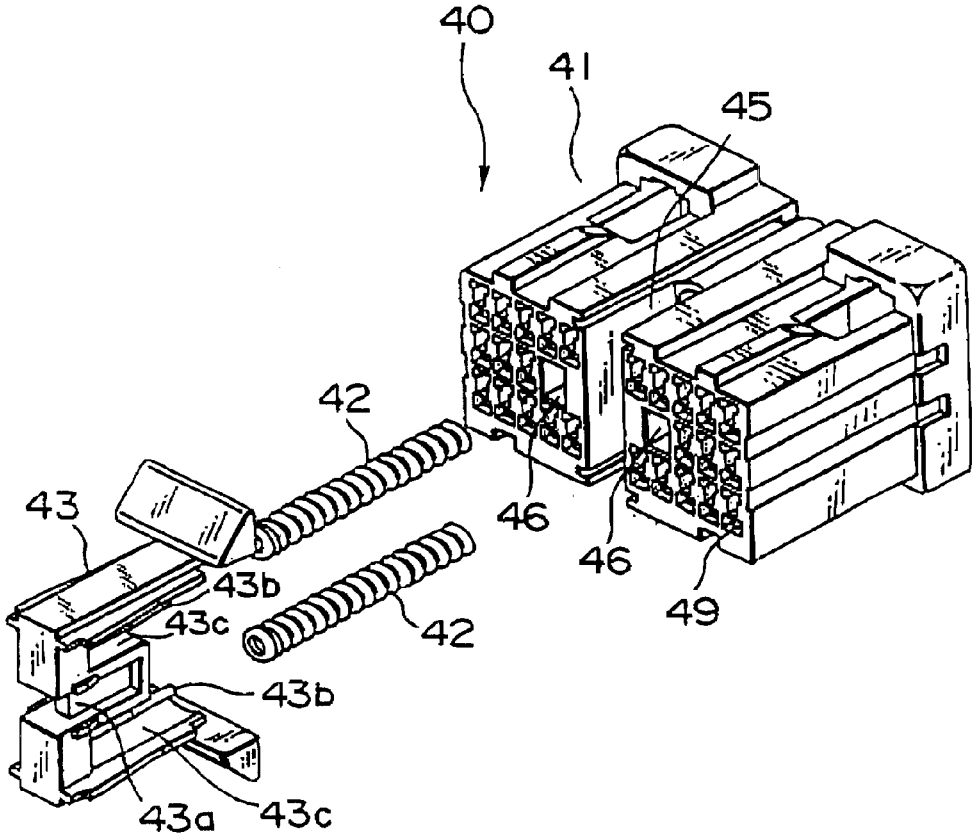
FIG. 6 PRIOR ART
FIG. 6 is an exploded perspective view of a socket connector in the second conventional electrical connector.
Figure 7:
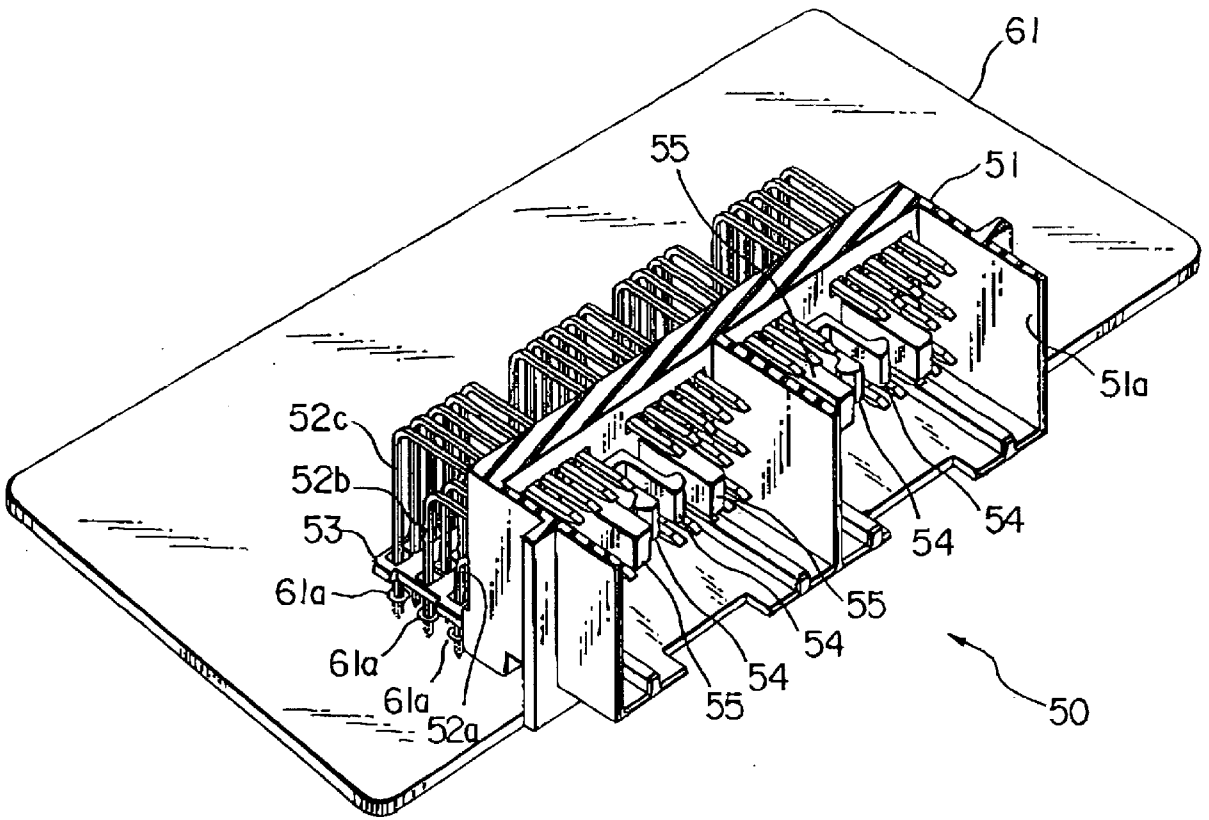
FIG. 7 PRIOR ART
FIG. 7 is a perspective view of a pin connector in the second conventional electrical connector installed on a printed circuit board. However, the upper portion of the pin connector is cut off.

Moreover, an essential point of a socket connector 71 in a third conventional electrical connector will be described referring to FIGS. 14 and 15.

An insulator 72 of the socket connector 71 is equipped with a plurality of contact accommodating chambers 72A by three steps structure. Each of a plurality of contacts 73 is accommodated in each of the accommodating chambers 72A, respectively. Each contact 73 has a rectangular-shaped stabilizer 73A at the center thereof and a touching portion 73B at the left side thereof. An electric wire 74 is connected at the right side of each contact 73. A double locking member 75 is installed movably in the top and bottom direction at the insulator 72.

Figure 14C:
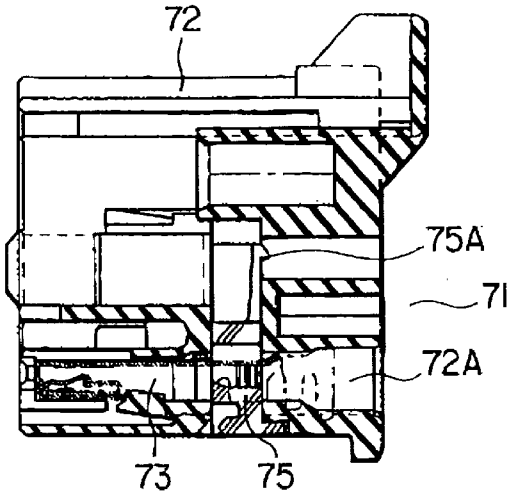
FIG. 14C PRIOR ART
Figure 14D:
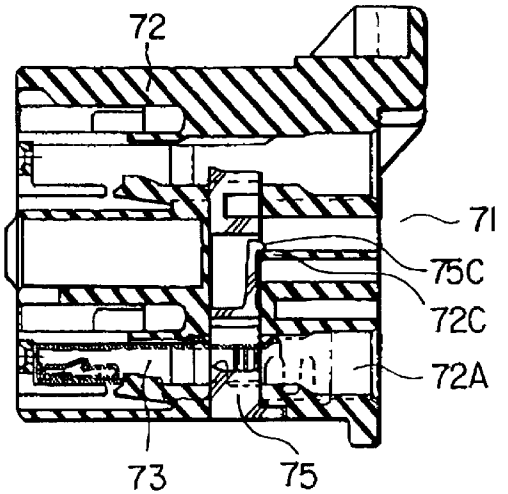
FIG. 14D PRIOR ART
Figure 14A:
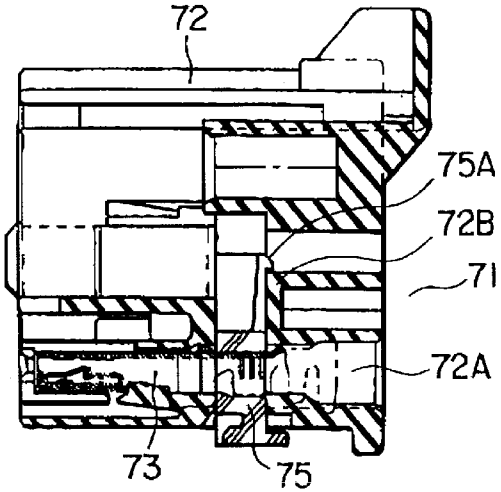
FIG. 14A PRIOR ART
Figure 14B:
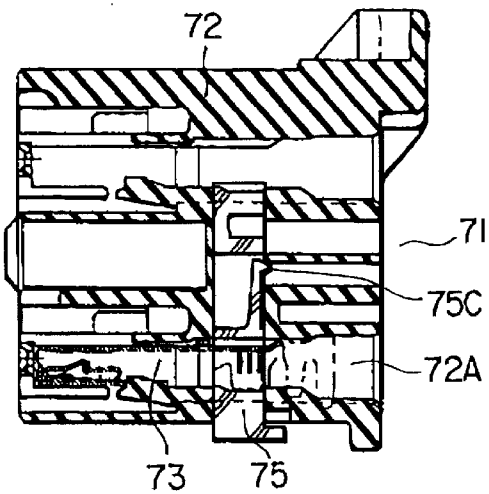
FIG. 14B PRIOR ART

In a temporary locking state of each contact 73 shown FIGS. 14A and 14B, a protrusion 75A formed at the double locking member 75 locks a corner 72B of the insulator 72 as shown FIG. 14A. Therefore, the double locking member 75 is prevented from pulling out of the insulator 72.

Figure 15B:
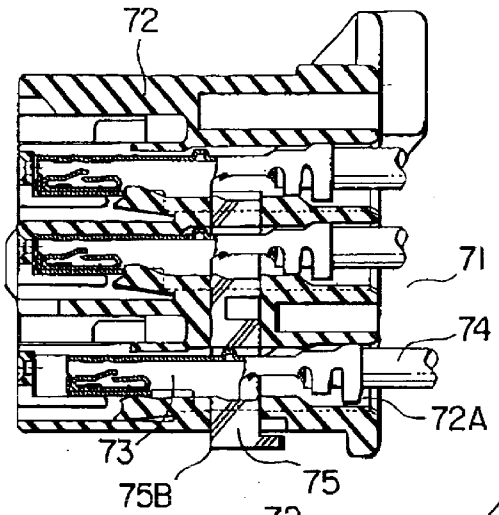
FIG. 15B PRIOR ART

FIG. 15B shows the state that each contact 73 is completely accommodated in the accommodating chambers 72A equipped at the upper and middle steps of the insulator 72, respectively, but a contact 73 is not completely accommodated in the accommodating chamber 72A equipped at the lower step of the insulator 72. In this state, since the double locking member 75 hits against the stabilizer 73A of the contact 73 accommodated at the lower step of the insulator 72, the double locking member 75 can not be pushed into the insulator 72. And besides, since the bottom portion 75B of the double locking member 75 protrudes from the bottom of the insulator 72, the socket connector 71 is prevented from engaging with a pin connector (not shown).

Figure 15D:
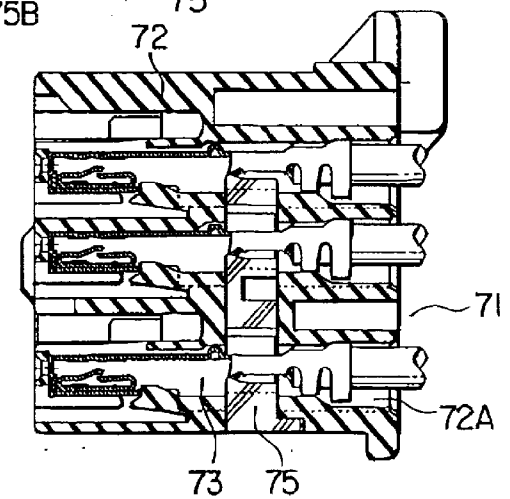
FIG. 15D PRIOR ART
Figure 15A:
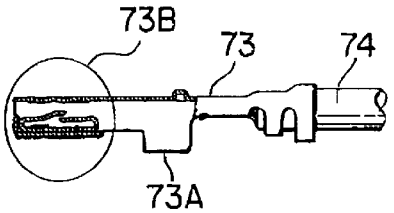
FIG. 15A PRIOR ART
Figure 15C:
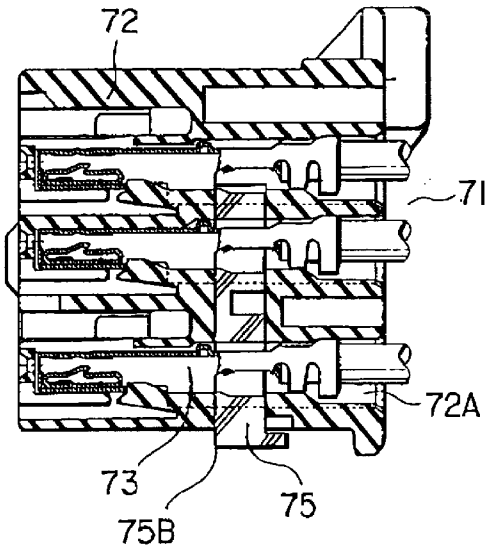
FIG. 15C PRIOR ART

When the contact 73 is completely accommodated in the accommodating chamber 72A equipped at the lower step of the insulator 72, all of the three contacts 73 become to the temporary locking state as shown in FIG. 15C.

Figure 8A:
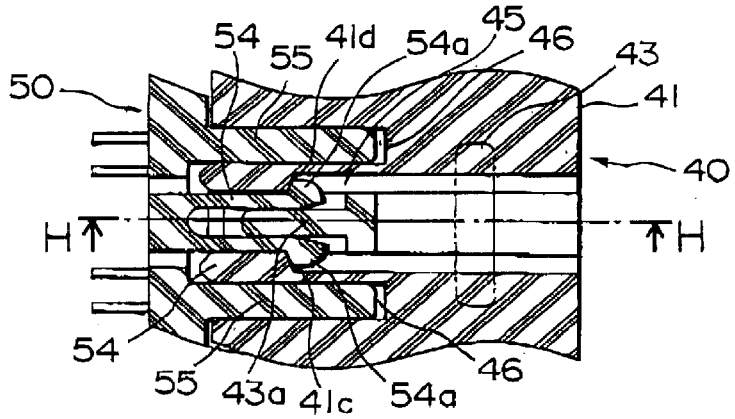
FIG. 8A PRIOR ART
FIG. 8A is a partial transverse sectional view of the second conventional electrical connector on engagement.
Figure 8B:
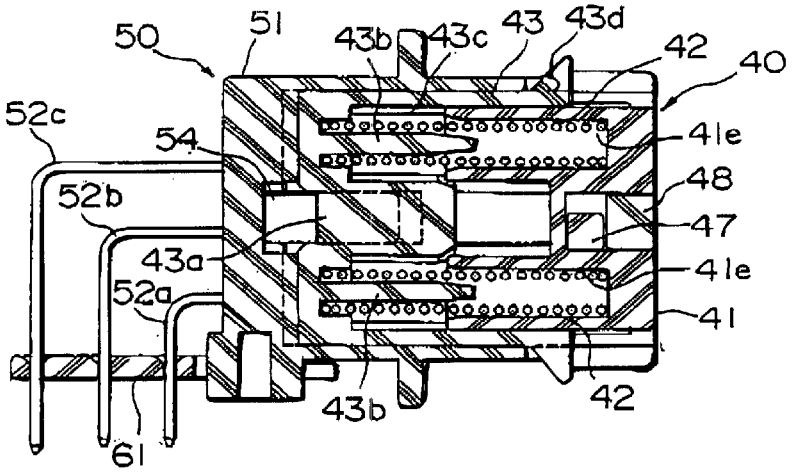
FIG. 8B PRIOR ART
FIG. 8B is a longitudinal sectional view along a line H—H in FIG. 8A.
Figure 8C:
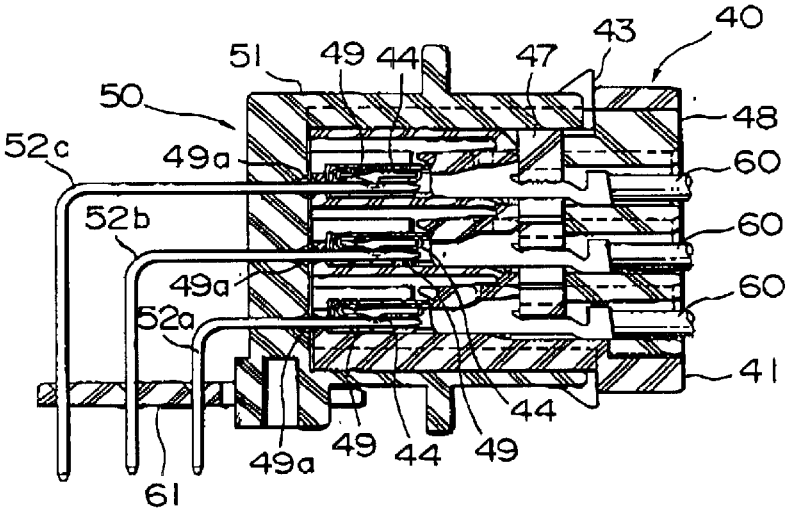
FIG. 8C PRIOR ART
FIG. 8C is another longitudinal sectional view of the second conventional electrical connector on engagement.
Figure 9A:
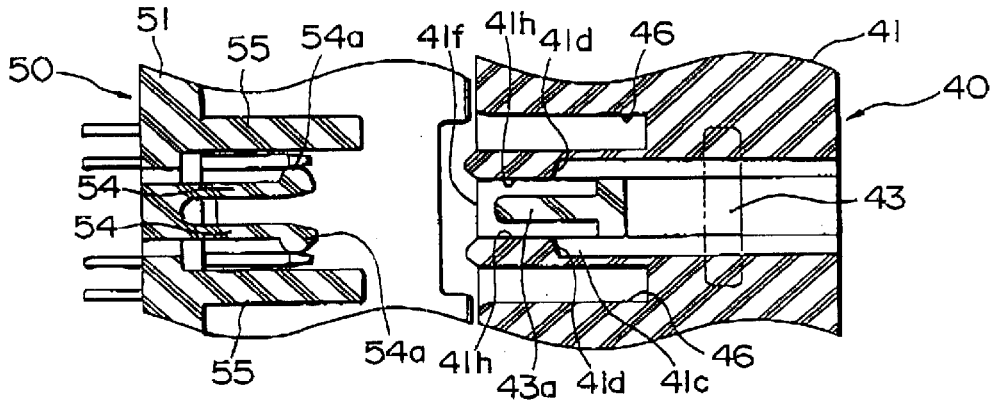
FIG. 9A PRIOR ART
FIG. 9A is a partial transverse sectional view of the second conventional electrical connector just before engagement.
Figure 9B:
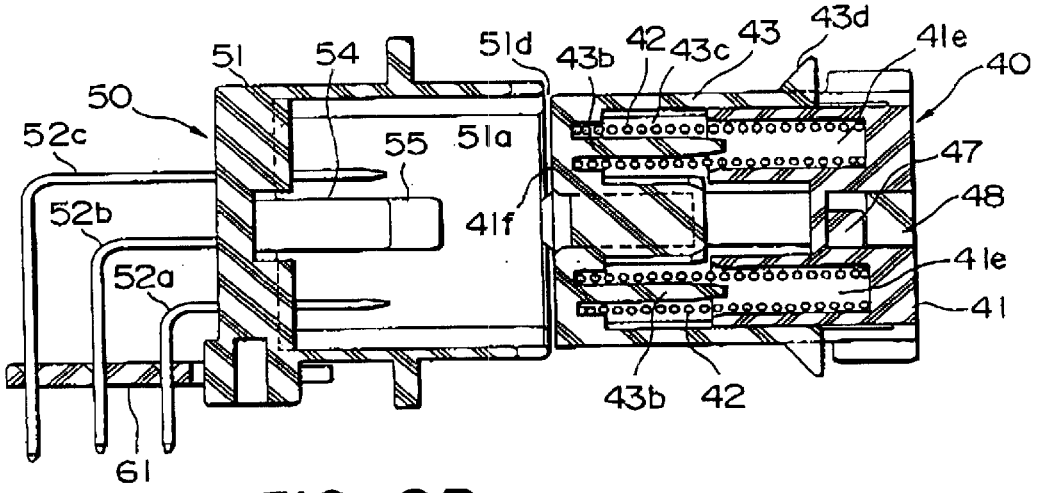
FIG. 9B PRIOR ART
FIG. 9B is a longitudinal sectional view along a line (not shown) in FIG. 9A corresponding the line H—H in FIG. 8A.
Figure 9C:
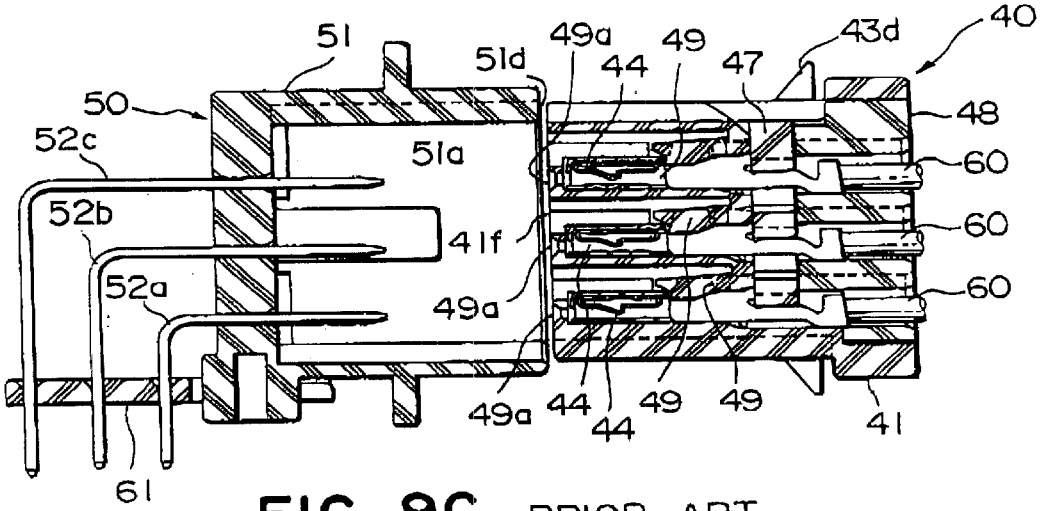
FIG. 9C PRIOR ART
FIG. 9C is another longitudinal sectional view of the second conventional electrical connector just before engagement.
Figure 10A:
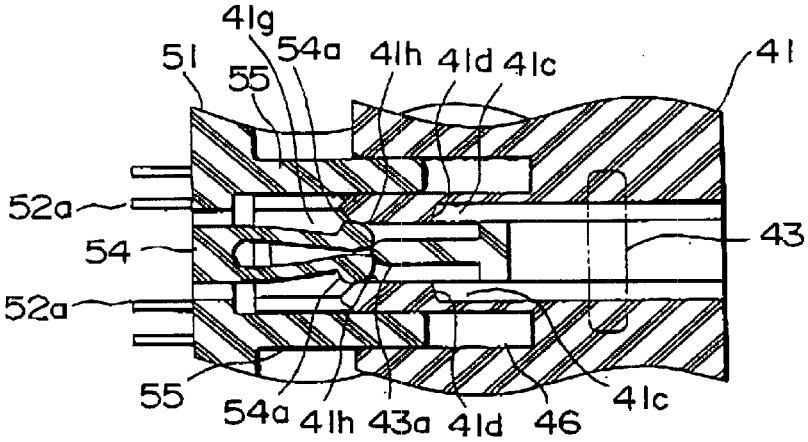
FIG. 10A PRIOR ART
FIG. 10A is a partial transverse sectional view of the second conventional electrical connector on a first engaging process.
Figure 10B:
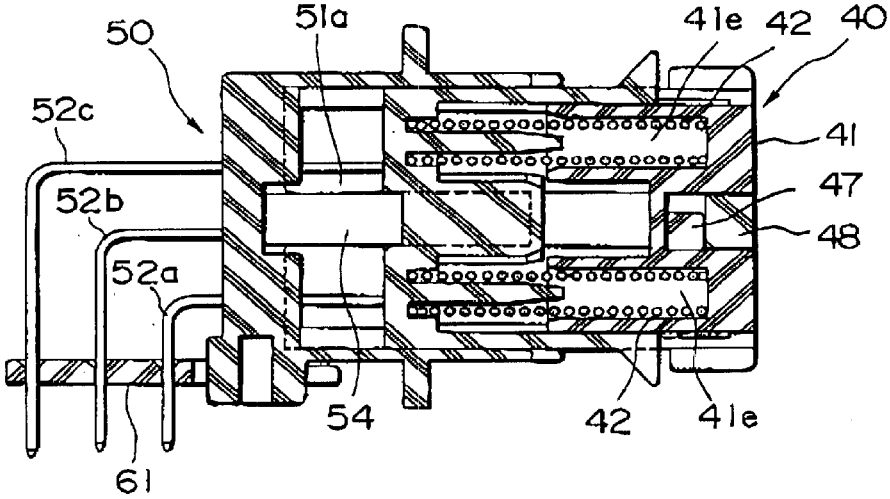
FIG. 10B PRIOR ART
FIG. 10B is a longitudinal sectional view along a line (not shown) in FIG. 10A corresponding the line H—H in FIG. 8A.
Figure 10C:
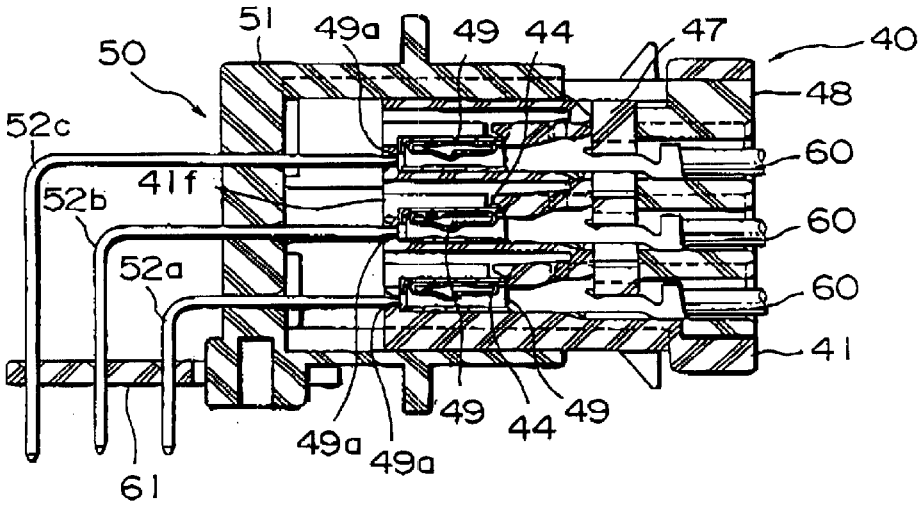
FIG. 10C PRIOR ART
FIG. 10C is another longitudinal sectional view of the second conventional electrical connector on the first engaging process; between the socket connector 40 and the pin connector 50 is released.
Figure 11A:
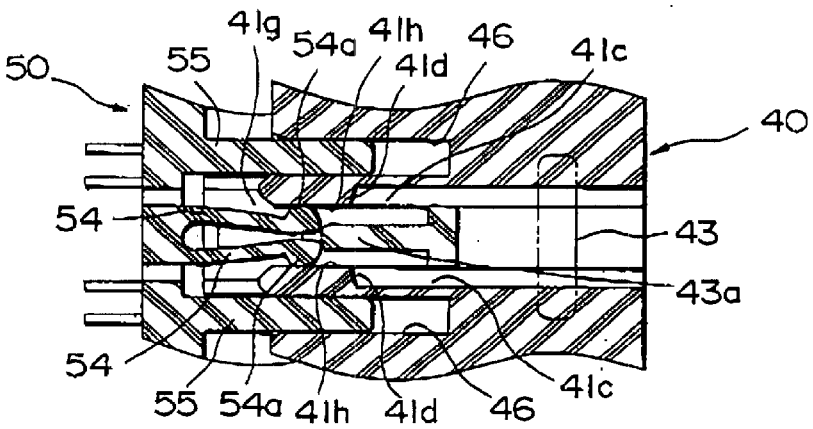
FIG. 11A PRIOR ART
Figure 11B:
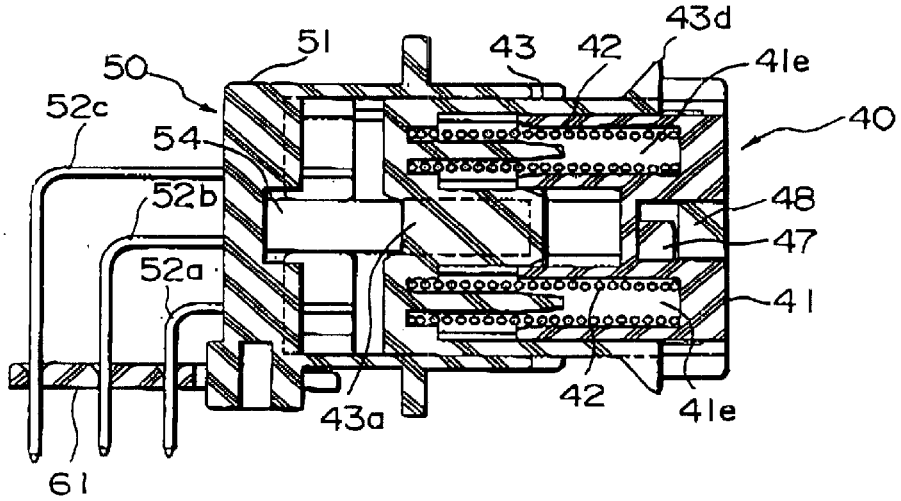
FIG. 11B PRIOR ART
Figure 11C:
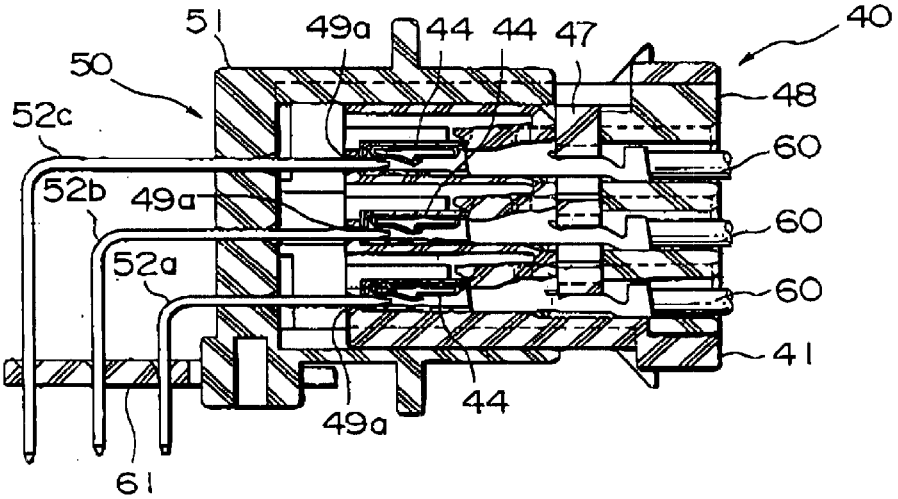
FIG. 11C PRIOR ART
Figure 12A:
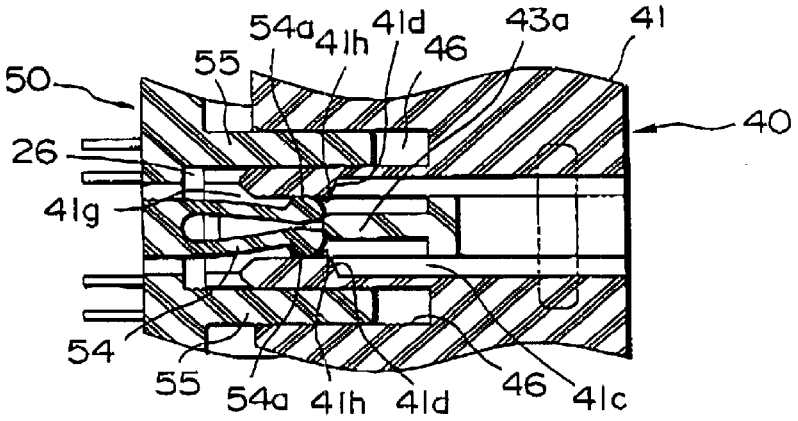
FIG. 12A PRIOR ART
Figure 12B:
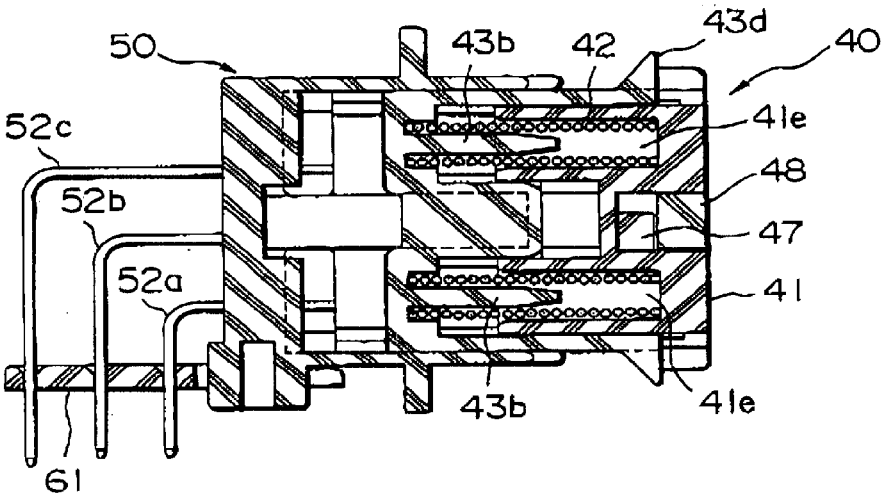
FIG. 12B PRIOR ART
Figure 12C:
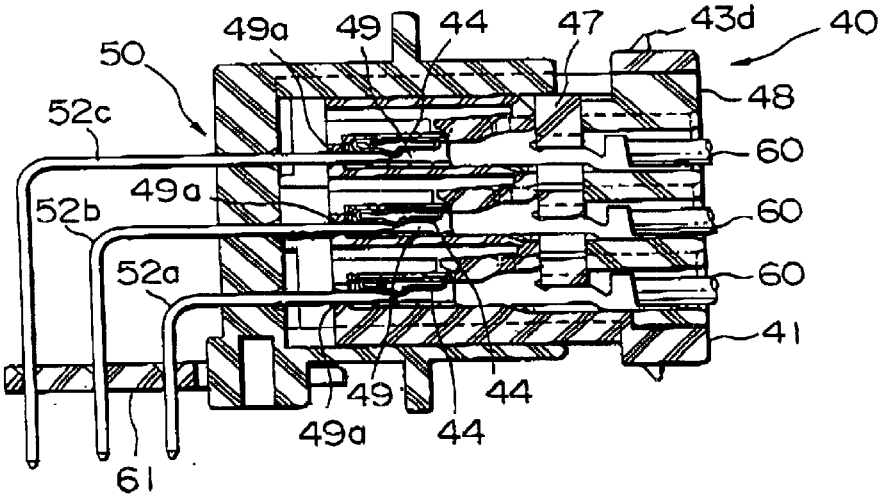
FIG. 12C PRIOR ART
Figure 13A:
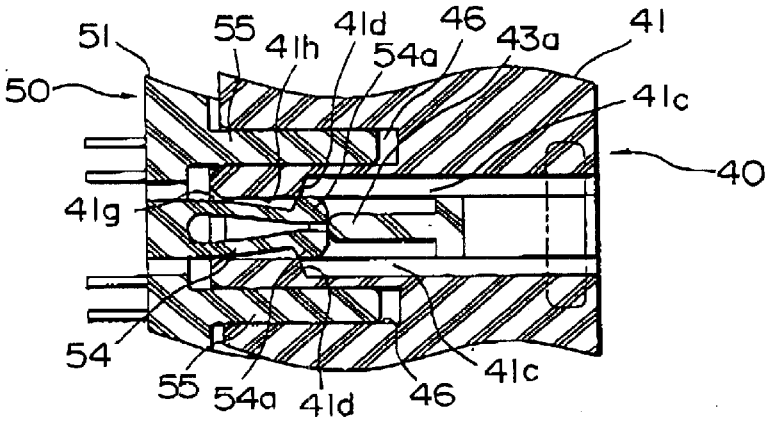
FIG. 13A PRIOR ART
Figure 13B:
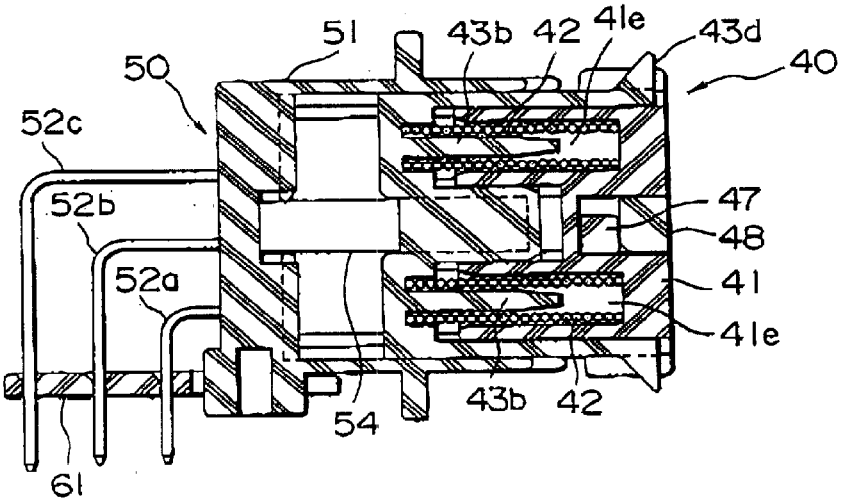
FIG. 13B PRIOR ART
Figure 13C:
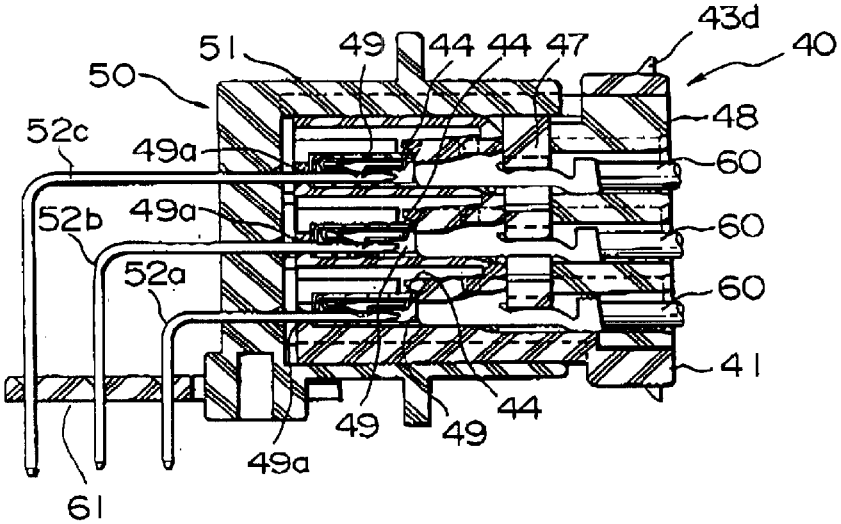
FIG. 13C PRIOR ART
Figure 16A:
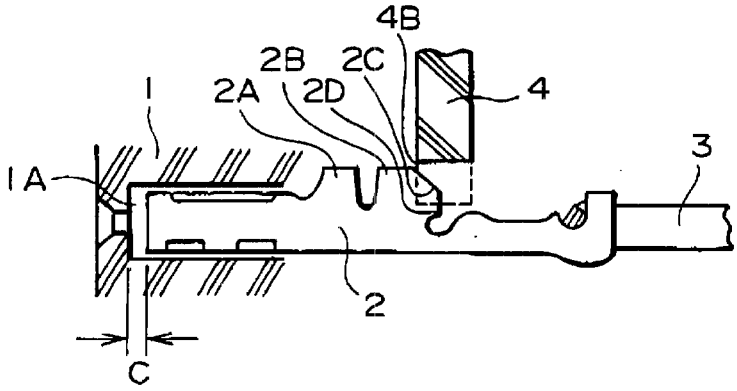
Figure 16B:
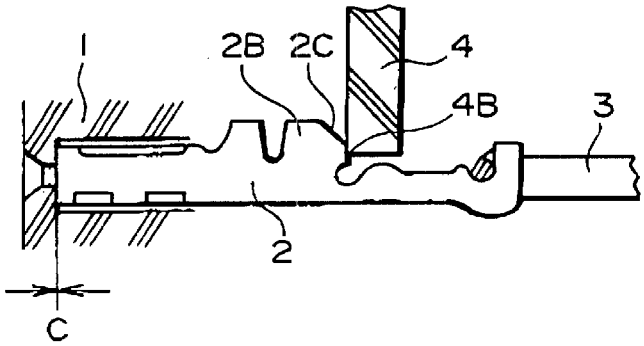
Figure 16C:
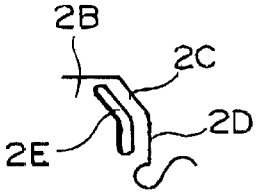
Figure 16D:
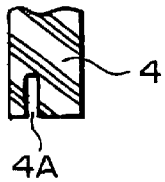
Figure 17A:
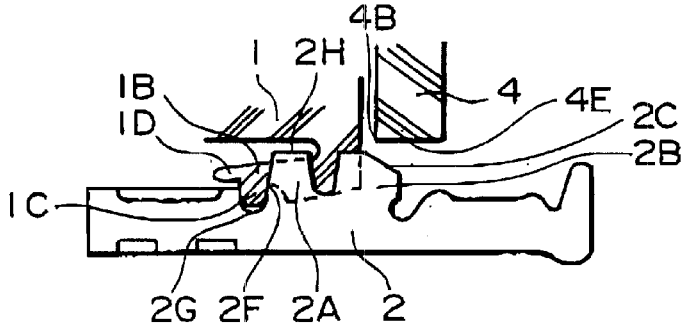
Figure 17B:
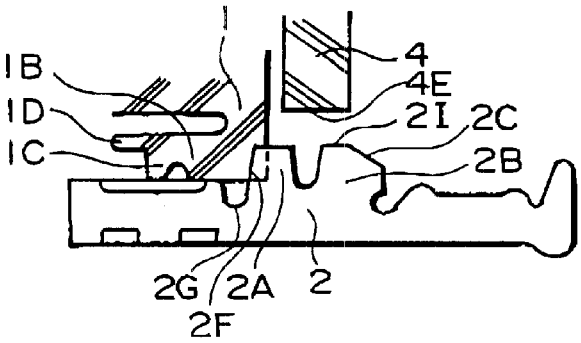
Figure 18A:
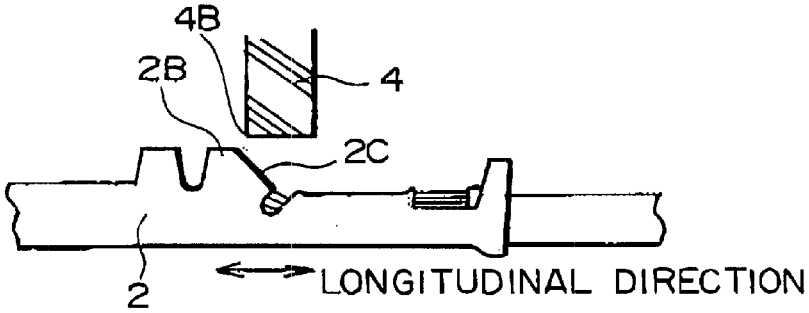
Figure 18B:
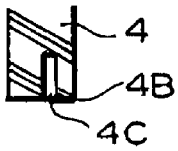
Figure 18C:
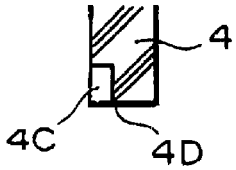
Figure 19C:
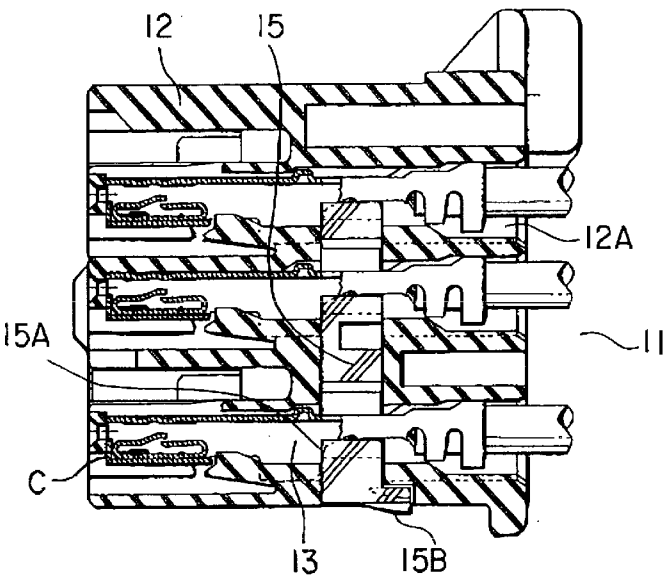
Figure 19A:
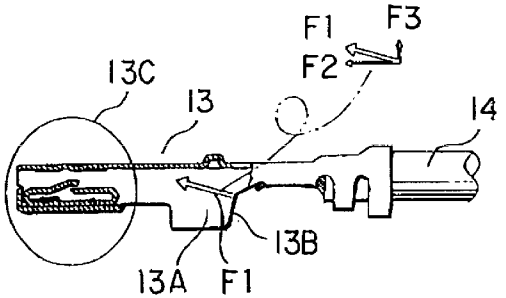
Figure 19B:
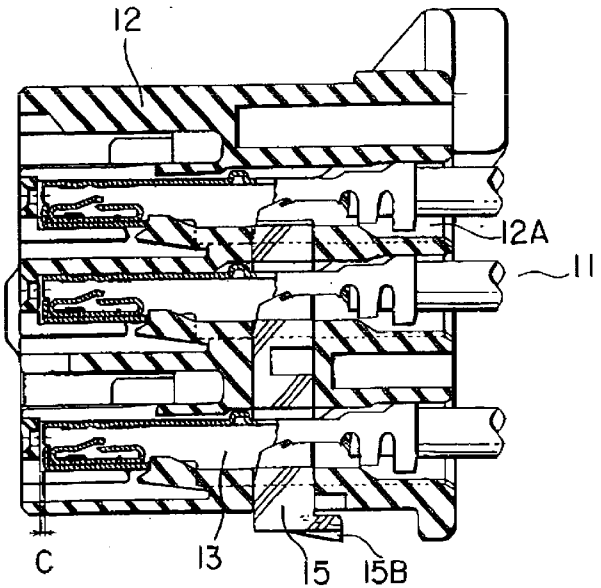
Figure 20B:
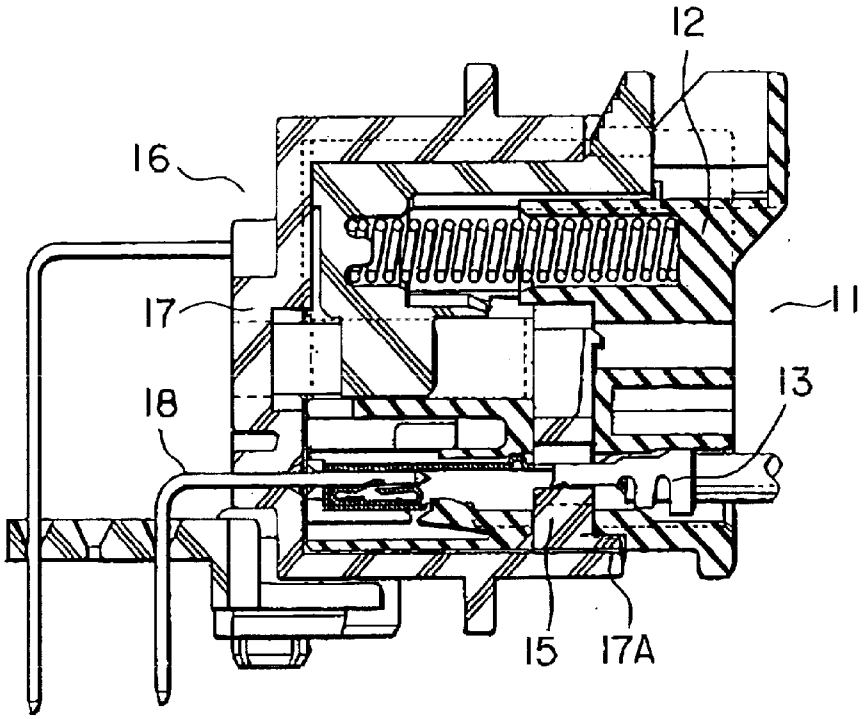
Figure 20A:
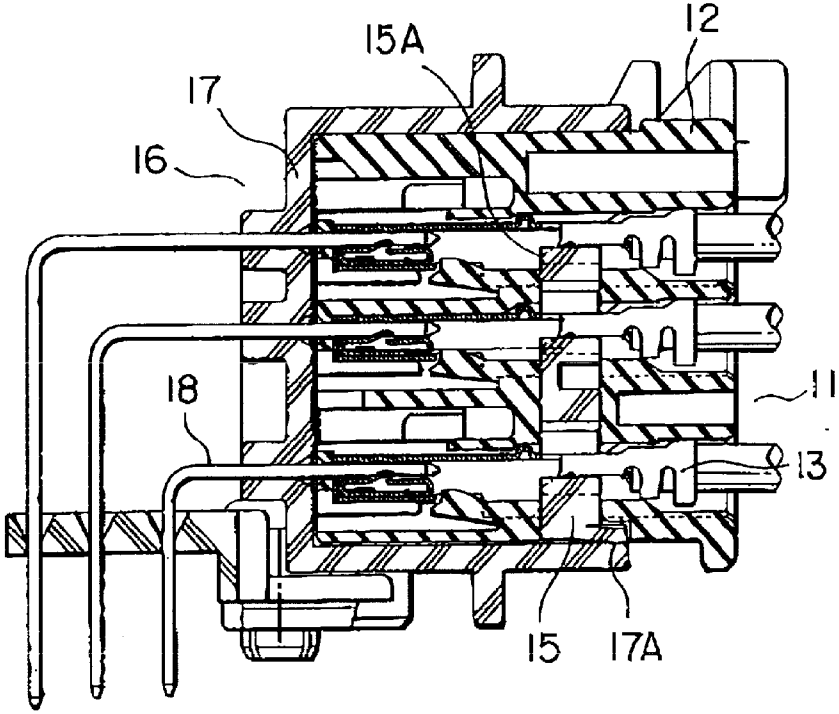

FIG. 11A is a partial transverse sectional view of the second conventional electrical connector on a second engaging process;

FIG. 11B is a longitudinal sectional view along a line (not shown) in FIG. 11A corresponding the line H—H in FIG. 8A;

FIG. 11C is another longitudinal sectional view of the second conventional electrical connector on the second engaging process;

FIG. 12A is a partial transverse sectional view of the second conventional electrical connector on a third engaging process;

FIG. 12B is a longitudinal sectional view along a line (not shown) in FIG. 12A corresponding the line H—H in FIG. 8A;

FIG. 12C is another longitudinal sectional view of the second conventional electrical connector on the third engaging process;

FIG. 13A is a partial transverse sectional view of the second conventional electrical connector on a fourth engaging process;

FIG. 13B is a longitudinal sectional view along a line (not shown) in FIG. 13A corresponding the line H—H in FIG. 8A;

FIG. 13C is another longitudinal sectional view of the second conventional electrical connector on the fourth engaging process;

FIG. 14A is a sectional view of a socket connector in a third conventional electrical connector in a temporary locking state;

FIG. 14B is another sectional view of the socket connector in the third conventional electrical connector in the temporary locking state;

FIG. 14C is a sectional view of the socket connector in the third conventional electrical connector in a regular locking state;

FIG. 14D is another sectional view of the socket connector in the third conventional electrical connector in the regular locking state;

FIG. 15A is a front view (partially a sectional view) of a contact of the socket connector in the third conventional electrical connector;

FIG. 15B is a sectional view of the socket connector in the third conventional electrical connector when one contact is not yet accommodated in an insulator;

FIG. 15C is a sectional view of the socket connector in the third conventional electrical connector in the temporary locking state;

FIG. 15D is a sectional view of the socket connector in the third conventional electrical connector in the regular locking state;

FIG. 16A is a sectional view of an electrical connector according to a first embodiment of this invention when a contact is located in a temporary locking state;

FIG. 16B is a sectional view of the electrical connector according to the first embodiment of this invention when the contact is located in a regular locking state;

FIG. 16C is an enlarged sectional view of a second stabilizer of the contact in the electrical connector according to the first embodiment of this invention;

FIG. 16D is an enlarged sectional view of a double locking member in the electrical connector according to the first embodiment of this invention;

FIG. 17A is a sectional view of an electrical connector according to a second embodiment of this invention when a contact is located in a temporary locking state;

FIG. 17B is a sectional view of the electrical connector according to the second embodiment of this invention when the contact has incompletely been inserted in an insulator;

FIG. 18A is a sectional view of an electrical connector according to a third embodiment of this invention when a contact is located in a temporary locking state;

FIG. 18B is a side view of a double locking member in the electrical connector according to the third embodiment of this invention;

FIG. 18C is a sectional view of the double locking member in the electrical connector according to the third embodiment of this invention;

FIG. 19A is a front view (partially a sectional view) of a contact of a socket connector in an electrical connector according to a fourth embodiment of this invention;

FIG. 19B is a sectional view of the socket connector in the electrical connector according to the fourth embodiment of this invention in a temporary locking state;

FIG. 19C is a sectional view of the socket connector in the electrical connector according to the fourth embodiment of this invention in a regular locking state;

FIG. 20A is a sectional view of the electrical connector according to the fourth embodiment of this invention in an engaging state; and FIG. 20B is another sectional view of the electrical connector according to the fourth embodiment of this invention in the engaging state.

DESCRIPTION OF THE PREFERRED EMBODIMENTS

The description will proceed to four electrical connectors having a double locking mechanism according to four preferred embodiments of this invention. However, the description will mainly proceed to peculiar portions of each embodiment and will not proceed to the same portions of the three conventional electrical connectors having the double locking mechanism above-mentioned.

At first, referring now to FIGS. 16A to 16D, the description will proceed to an electrical connector having the double locking mechanism according to a first preferred embodiment of this invention.

In FIG. 16A, a socket contact 2 is accommodated in one of a plurality of contact accommodating chambers 1A formed at an insulator 1, respectively. A generally trapezoid-shaped first stabilizer 2A and a second stabilizer 2B are formed at the upper portion of the center of the socket contact 2. An electric wire 3 is connected with the right end of the socket contact 2. The insulator 1 is made of plastics with elasticity such as polymer alloy and the like.

As shown in FIG. 16C, a slit 2E is formed along an inclined surface 2C and a perpendicular surface 2D of the socket contact 2. And besides, as shown in FIG. 16D, a slit 4A is formed at the bottom of a double locking member 4. The slit 2E and the slit 4A are formed so that the second stabilizer 2B and the double locking member 4 can deform elastically with ease, respectively, In the state of FIG. 16A, there is a little clearance C between the left end wall of the contact accommodating chamber 1A and the left end surface of the socket contact 2. In this state, when the double locking member 4 is pushed down from a temporary locking position illustrated by a solid line to a regular locking position illustrated by a broken line, an engaging portion 4B of the left side bottom of the double locking member 4 pushes the inclined surface 2C of the second stabilizer 2B. Accordingly, as shown in FIG. 16B, the socket contact 2 moves to the left direction. When the left end of the socket contact 2 has hit against the left end wall of the contact accommodating chamber 1A, the socket contact 2 stops. At this time, the clearance C becomes naught. Since the socket contact 2 can not move to the insulator 1, a pin contact of a pin connector (not shown) can stably connect with the socket contact 2.

Next, referring now to FIGS. 17A and 17B, the description will proceed to an electrical connector having a double locking mechanism according to a second preferred embodiment of this invention.

An elastically deformable lance 1B is formed at a socket insulator 1. A pair of generally U-shaped end portions 1C and 1D is formed at the end of the lance 1B. A first stabilizer 2A and a second stabilizer 2B are formed at the upper portion of the center of a contact 2. An inclined surface 2F and a concavity 2G continuing the inclined surface 2F are formed at the first stabilizer 2A.

FIG. 17A shows a temporary locking state that the end portion 1C of the lance 1B has been inserted in the concavity 2G of the contact 2. In this state, a double locking member 4 can be pushed down as well as the first embodiment above-mentioned. When the double locking member 4 is pushed down, an engaging portion 4B of the double locking member 4 pushes the inclined surface 2C of the second stabilizer 2B. Then, since the contact 2 moves to the left direction, the end portion 1C of the lance 1B rides on the top surface 2H of the first stabilizer 2A by way of the inclined surface 2F. In the temporary locking state, how to release the lance 1B from the contact 2 is as follows. At first, a tip of a screw driver etc. is inserted between the pair of the end portions 1*c* and 1D. Next, the end portion 1D is lifted up. Thereupon, the end portion 1C escapes from the concavity 2G.

FIG. 17B shows the state that the contact 2 has been inserted halfway in a contact accommodating chamber (not shown) of the insulator 1. That is to say, the contact 2 has not yet been inserted in the temporary locking position by the lance 1B. In this state, when the double locking member 4 is pushed down, the bottom plane 4E thereof hits against the top surface 21 of the second stabilizer 2B. Therefore, the double locking member 4 can not be pushed down any more.

Further, referring now to FIGS. 18A to 18C, the description will proceed to an electrical connector having a double locking mechanism according to a third preferred embodiment of this invention.

A groove 4C is formed in the vicinity of an engaging portion 4B of a double locking member 4. When the double locking member 4 has been pushed down, the groove 4C holds an inclined plane 2C of a second stabilizer 2B, and a comer 4D of the groove 4C pushes the inclined plane 2C to the left direction. And so, a contact 2 moves to the left direction as well as the first embodiment above-mentioned. Consequently, the contact 2 is prevented from shaking to the direction perpendicular to the longitudinal direction thereof.

Furthermore, referring now to FIGS. 19A to 20B, the description will proceed to an electrical connector having a double locking mechanism according to a fourth preferred embodiment of this invention.

At first, referring to FIGS. 19A to 19C, the description will proceed to a socket connector 11. A contact 13 is accommodated in one of a plurality of contact accommodating chambers 12A provided at an insulator 12 by three steps structure, respectively. An Inclined plane 13B is formed at a stabilizer 13A of each contact 13. An electric wire 14 is connected with each contact 13. A double locking member 15 is installed movably to the vertical direction in the insulator 12.

In a temporary locking state shown in FIG. 19B, there is a little clearance C between the left end wall of the contact accommodating chamber 12A and the left end of the contact 13. In this state, when the double locking member 15 has been pushed up to a regular locking position, an end 15A of the double locking member 15 gives the inclined plane 13B of the contact 13 a force F1 of the inclined direction. The force F1 is divided into a component force F2 of the forward direction and a component F3 of the upward direction. The contact 13 moves to the left direction by the component force F2. When the left end plane of the contact 13 has hit against the left end wall of the contact accommodating chamber 12A, the contact 13 stops. At this time, since the clearance C becomes naught, the contact 13 can not move to the insulator 12.

Next, referring to FIGS. 20A and 20B, the description will proceed to engagement between the socket connector 11 and a pin connector 16. A plurality of contacts 18 are installed in an insulator 17 of the pin connector 16 by three steps structure. In the engaging state shown in FIGS. 20A and 20B, an end of each contact 18 of the pin connector 16 comes into contact with a touching portion 13C (refer FIG. 19A) of each contact 13 of the socket connector 11. And besides, as shown in FIGS. 19B and 19C, an elastically deformable protrusion 15B is formed at the bottom of the double locking member 15. When the socket connector 11 engages with the pin connector 16, the inside end 17A of the lower portion of the insulator 17 of the pin connector 16 hits against the protrusion 15B. Therefore, the protrusion 15B deforms elastically. As a result, the double locking member 15 is prevented from shaking of the vertical direction (in FIGS. 20A and 20B) to the insulator 12.

As will be apparent from the above-mentioned description, this invention can obtain the following effects.

1. The guiding portion (i.e. the inclined plane) of the stabilizer of the contact can smoothly engage with the engaging portion of the double locking member. And besides, the contact inserted into the insulator is prevented from shaking to the longitudinal direction thereof. Therefore, when a vibration etc. happen after the connector has engaged with the mating connector, a fretting corrosion does not occur between the contact and the mating contact.

2. Since the groove formed at the engaging portion of the double locking member holds the stabilizer of the contact, the contact is prevented from shaking to the direction perpendicular to the longitudinal direction thereof.

3. This invention provides the electrical connector having the double locking mechanism with a simple structure, a few parts, and a low price of manufacturing cost.

4. In the state in which the contact has incompletely been inserted into the insulator, the double locking member can not be operated. Accordingly, the incomplete inserting state is easily distinguished from the temporary locking state and the regular locking state.

What is claimed is:

1. An electrical connector having a contact double-locking structure for locking a contact (24, 2, 13) inserted into a contact hole (23*c*, 1A, 12A) in an insulator (21, 1, 12), said double-locking structure comprising a double locking member (22, 4, 15), said double-locking member can move in a direction perpendicular to an inserting direction of said contact (24, 2, 13) in said insulator (21, 1, 12) between a temporary looking position where said double-locking member (22, 4, 15) is temporarily locked with a portion (27*a*) of said insulator (21, 1, 12) and a regular locking position where said double-locking member (22, 4, 15) is regularly locked at a different position in said insulator (21, 1, 12), said double-locking member (22, 4, 15) being prevented from moving from said temporary locking position to said regular locking position by a stabilizer (24*b*, 2D, 13A) of said contact (24, 2, 13) when said contact (24, 2, 13) is incompletely inserted into said contact hole (23*c*, 1A, 12A), said double-locking member (22, 4, 15) can move from said temporary locking position to said regular locking position when said contact (24, 2, 13) is completely inserted into said contact hole (23*c*, 1A, 15A), said double-locking member (22, 4, 15) having an engaging portion (4B, 15A) for engaging with said stabilizer (24*b*, 2D, 13A) to prevent said contact (24, 2, 13) from moving out of said contact hole (23*c*, 1A, 12A) in the opposite direction to the inserting direction when said double-locking member (22, 4, 15) is in the regular locking position, wherein said stabilizer (2D, 13A) has a guiding portion (2C, 13B) for guiding said engaging portion (4B, 15A) therealong when said double-locking member (4, 15) is moved into said regular locking position, whereby said contact (2, 13) is moved in the inserting direction and is brought into its completely inserted position without clearance (C) between said stabilizer (2D, 13A) and said engaging portion (4B, 15A).

2. An electrical connector as claimed in claim 1, wherein said guiding portion (2C, 13B) is an inclined plane.

3. An electrical connector as claimed in claim 1, wherein said stabilizer (2B) is equipped with a slit (2E) and is elastically deformable.

4. An electrical connector as claimed in claim 1 or 2, wherein said engaging portion (4B) is equipped with a groove (4A, 4C) for holding said, stabilizer (28) to prevent said contact (2) from moving in a direction perpendicular to the longitudinal direction of said contact (2).

5. An electrical connector as claimed in claim 3, wherein said engaging portion (4B) is equipped with a groove (4A, 4C) for holding said stabilizer (2B) to prevent said contact (2) from moving in a direction perpendicular to the longitudinal direction of said contact (2).

6. An electrical connector as claimed in claim 1, wherein said connector has a plurality of contacts (2, 13) with stabilizers (2B, 13A) held in a plurality of contact holes (1A, 12A) in said insulator (1, 12), said double-locking member (4, 15) has a plurality of engaging portions (4B, 15A) which prevent said contacts (2, 13), respectively, from moving in the opposite direction to the inserting direction by engaging with stabilizers (2B, 13A) of the contacts (2, 13), respectively.

7. An electrical connector as claimed in claim 6, wherein said stabilizer (2B, 13A) is elastically deformable.

8. An electrical connector as claimed in claim 7, wherein said stabilizer (28) is equipped with a slit (2E).

* * * * *